US008201926B2

(12) United States Patent
Shimada

(10) Patent No.: US 8,201,926 B2
(45) Date of Patent: Jun. 19, 2012

(54) LIQUID EJECTING HEAD, LIQUID EJECTING APPARATUS, AND ACTUATOR

(75) Inventor: Masato Shimada, Chino (JP)

(73) Assignee: Seiko Epson Corporation, Tokyo (JP)

( * ) Notice: Subject to any disclaimer, the term of this patent is extended or adjusted under 35 U.S.C. 154(b) by 231 days.

(21) Appl. No.: 12/721,230

(22) Filed: Mar. 10, 2010

(65) Prior Publication Data

US 2010/0231658 A1 Sep. 16, 2010

(30) Foreign Application Priority Data

Mar. 11, 2009 (JP) ..... 2009-058759

(51) Int. Cl.
*B41J 2/045* (2006.01)

(52) U.S. Cl. ..... 347/68; 347/70; 347/71; 347/72; 347/58

(58) Field of Classification Search ..... 347/68–72, 347/50, 57–59
See application file for complete search history.

(56) References Cited

U.S. PATENT DOCUMENTS

| | | | | |
|---|---|---|---|---|
| 6,502,928 | B1 * | 1/2003 | Shimada et al. | 347/68 |
| 7,388,319 | B2 * | 6/2008 | Bibl et al. | 310/331 |
| 7,608,983 | B2 * | 10/2009 | Sugahara | 310/324 |
| 7,637,600 | B2 | 12/2009 | Yazaki | |

FOREIGN PATENT DOCUMENTS

| | | |
|---|---|---|
| JP | 2007-118193 | 5/2007 |
| JP | 2007-216429 | 8/2007 |

* cited by examiner

*Primary Examiner* — Matthew Luu
*Assistant Examiner* — Henok Legesse
(74) *Attorney, Agent, or Firm* — Workman Nydegger

(57) ABSTRACT

A liquid ejecting head includes a flow channel forming substrate in which pressure generating chambers in communication with nozzles are formed; a piezoelectric element made up of a first electrode formed over the flow channel forming substrate, a piezoelectric layer formed over the first electrode and a second electrode formed over the piezoelectric layer; and a coating film provided by coating the piezoelectric element, wherein a hollow section formed by removing the coating film and a part of the second electrode is provided at an area opposite to the piezoelectric element, and an inclination angle θ1 of an end face of the coating film defining the hollow section with respect to the flow channel forming substrate and an inclination angle θ2 of an end face of the second electrode defining the hollow section satisfy a relationship of θ2<θ1.

6 Claims, 6 Drawing Sheets

LIQUID EJECTING HEAD, LIQUID EJECTING APPARATUS, AND ACTUATOR

The entire disclosure of Japanese Patent Application No. 2009-058759, filed Mar. 11, 2009 is expressly incorporated by reference herein.

BACKGROUND

1. Technical Field

The present invention relates to a liquid ejecting head, a liquid ejecting apparatus, and an actuator, which eject liquid droplets from a nozzle by piezoelectric element displacement.

2. Related Art

As a representative example of the liquid ejecting head which discharges liquid droplets, an ink jet recording head mounted on an ink jet recording apparatus is known. An ink jet recording head is configured, for example, such that a vibrating plate constituting a part of a pressure generating chamber is deformed by a piezoelectric element to pressurize the ink in the pressure generating chamber so as to eject ink from a nozzle in communication with the pressure generating chamber. In addition, as such an ink jet recording head, two kinds of ink jet recording heads, i.e., one using an actuator with a longitudinal vibration mode which expands and contracts in an axial direction of the piezoelectric element and the other one using an actuator with a flexural vibration mode are in practical use.

As one using the actuator with a flexural vibration mode, for example, there is provided an ink jet recording head in which a uniform piezoelectric material layer is formed all over the surface of the vibrating plate by a deposition technique, and the piezoelectric material layer is cut into a shape corresponding to the pressure generating chamber by a lithography process so as to form a piezoelectric element to be independent for every pressure generating chamber.

The piezoelectric element formed of such a thin film is advantageous in that it can be arranged at a high density and driven at a high speed, but has a problem that it is easily broken due to the external environmental causes such as humidity, for example. To solve this problem, a coated film is provided by coating the piezoelectric element. However, this causes a problem that the piezoelectric element is restrained by the coated film and thereby the displacement amount of the piezoelectric element is decreased.

As a solution to this problem, there is a solution in which a hollow section having no coated film (protecting film) at an area corresponding to main portion of an upper electrode constituting the piezoelectric element is provided (see, for example, JP-A-2007-216429 and FIG. 3). By providing such a hollow section, it is possible to prevent breakage of the piezoelectric element due to the external environment by the coated film and also suppress decrease in the displacement amount of the piezoelectric element.

However, as described in JP-A-2007-216429, the hollow section is generally formed by etching the coated film (protecting film). If the hollow section is formed by etching the coated film as such, there is a risk that, for example, the coated film will remain thinly at a peripheral portion or the like of the hollow section and the coated film will be separated from that portion.

With respect to this problem, the removal of a part of the upper electrode together with the coated film when forming the hollow section is considered. This allows complete removal of the coated film of the hollow section. However, there is a risk that stress concentration will occur at an end portion of the hollow section (end face portions of the coated film and the upper electrode) in a width direction (lateral direction) of the piezoelectric element, and cracks will occur in the piezoelectric element from this portion as a starting point.

Furthermore, such a problem is similarly present in a liquid ejecting head which ejects liquid droplets other than ink as well as in the ink jet recording head which ejects ink droplets. In addition, such a problem is similarly present in an actuator including the piezoelectric element as well as in the liquid ejecting head.

SUMMARY

An advantage of some aspects of the invention is to provide a liquid ejecting head, a liquid ejecting apparatus, and an actuator which can suppress breakage of a piezoelectric element due to stress concentration at an end portion of a hollow section.

According to a first aspect of the invention, there is provided a liquid ejecting head including: a flow channel forming substrate in which pressure generating chambers in communication with nozzles are formed; a piezoelectric element made up of a first electrode formed over the flow channel forming substrate, a piezoelectric layer formed over the first electrode and a second electrode formed over the piezoelectric layer; and a coating film provided by coating the piezoelectric element, wherein a hollow section formed by removing the coating film and a part of the second electrode is provided at an area opposite to the piezoelectric element, and an inclination angle $\theta 1$ of an end face of the coating film defining the hollow section with respect to the flow channel forming substrate and an inclination angle $\theta 2$ of an end face of the second electrode defining the hollow section satisfy a relationship of $\theta 2<\theta 1$.

With this configuration, since stress concentration at an end portion of the hollow section is suppressed, it is possible to suppress the occurrence of cracks in the piezoelectric element from this portion as a starting point. In particular, in an end portion of the hollow section in a width direction (lateral direction) of the piezoelectric element, the occurrence of cracks is significantly suppressed.

Here, in a case in which an inclination angle of an end face of the coated film or the second electrode constituting the hollow section changes in a depth direction of the hollow section, the inclination angle $\theta 1$ is an inclination angle of a straight line connecting an upper end and a lower end of the end face of the coated film with respect to the flow channel forming substrate, and the inclination angle $\theta 2$ is an inclination angle of a straight line connecting an upper end and a lower end of the end face of the second electrode with respect to the flow channel forming substrate.

Then, the case in which an inclination angle of an end face of the coated film or the second electrode constituting the hollow section changes in a depth direction of the hollow section refers to, for example, a case in which at least one of the end face of the coated film and the end face of the second electrode constituting the hollow section is formed by a curved surface, and a case in which at least one of the end face of the coated film and the end face of the second electrode constituting the hollow section is formed by a plurality of sloping surfaces of different inclination angles.

In addition, according to another aspect of the invention, there is provided a liquid ejecting apparatus including the above liquid ejecting head. With this invention, it is possible to realize a liquid ejecting apparatus which has an improved durability and reliability.

Furthermore, there is provided an actuator including: a piezoelectric element made up of a first electrode formed over a substrate, a piezoelectric layer formed over the first electrode and a second electrode formed over the piezoelectric layer; and a coating film provided by coating the piezoelectric element, wherein a hollow section formed by removing the coating film and a part of the second electrode is provided at an area opposite to the piezoelectric element, and an inclination angle θ1 of an end face of the coating film defining the hollow section with respect to the flow channel forming substrate and an inclination angle θ2 of an end face of the second electrode defining the hollow section satisfy a relationship of $\theta 2<\theta 1$.

With this configuration, since stress concentration at an end portion of the hollow section is suppressed, it is possible to suppress the occurrence of cracks in the piezoelectric element from this portion as a starting point. In particular, in an end portion of the hollow section in a width direction (lateral direction) of the piezoelectric element, the occurrence of cracks is significantly suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the accompanying drawings.

Figure 1:
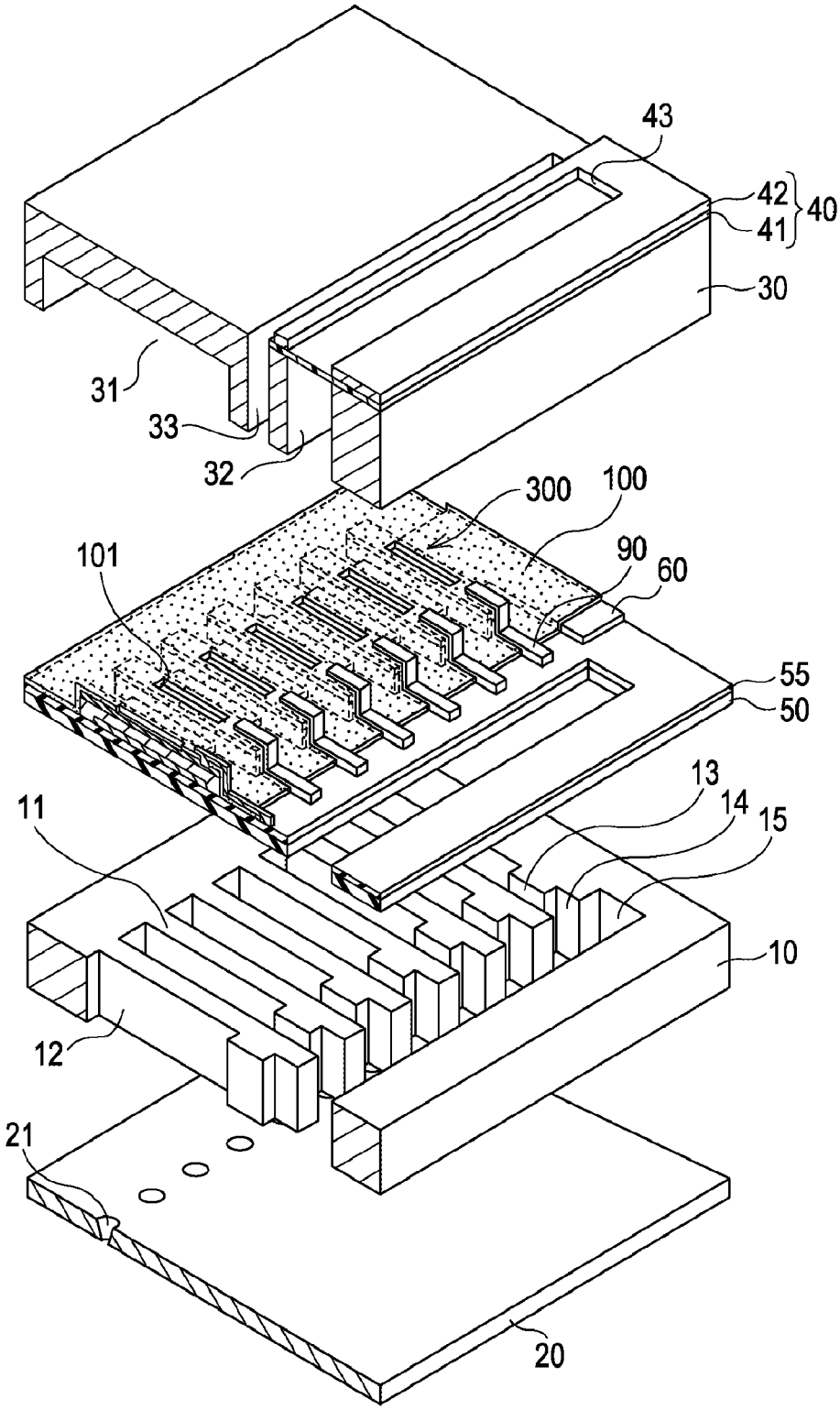
FIG. 1 is an exploded perspective view showing a schematic configuration of a recording head according to an embodiment of the invention.
Figure 2:
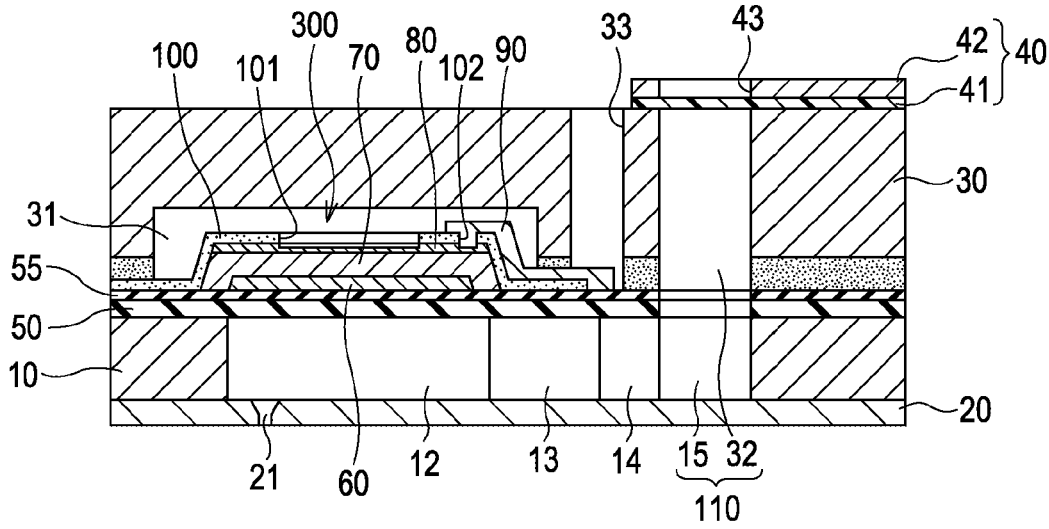
FIG. 2 is a sectional view of the recording head according to an embodiment of the invention.
Figure 3:
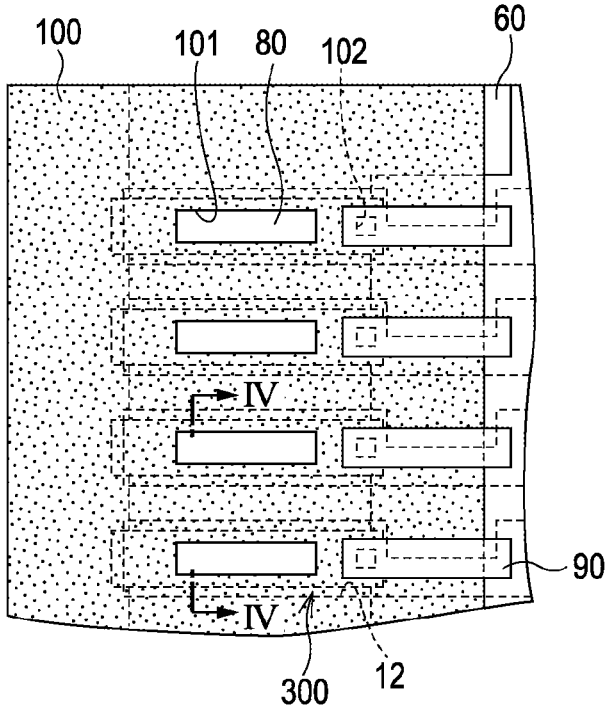
FIG. 3 is a plan view showing the configuration of the piezoelectric element according to an embodiment of the invention.
Figure 4:
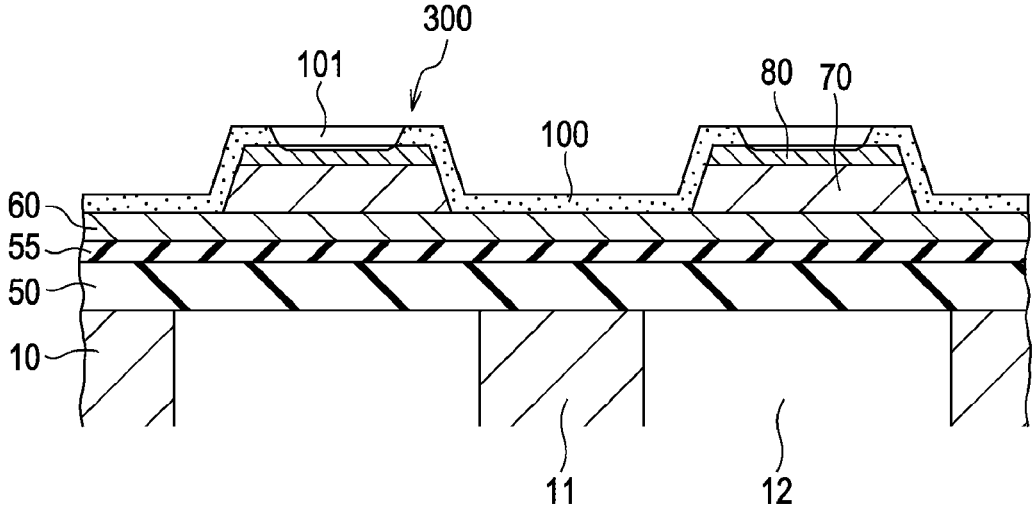
FIG. 4 is a sectional view showing the configuration of the piezoelectric element according to an embodiment of the invention.

FIG. 1 is an exploded perspective view showing a schematic configuration of an ink jet recording head as a liquid ejecting head according to an embodiment of the invention, and FIG. 2 is a sectional view thereof. In addition, FIG. 3 is a plan view showing the configuration of the piezoelectric element, and FIG. 4 is a sectional view taken along the line IV-IV of FIG. 3.

A flow channel forming substrate 10 constituting an ink jet recording head is, in this embodiment, formed of a silicon single crystal substrate having a crystal face orientation of (110) and, as shown, is provided with an elastic film 50 formed of oxide film at one side thereof. The flow channel forming substrate 10 includes a plurality of pressure generating chambers 12 which are divided by partitioning walls 11, one side surface of which is constructed by the elastic film 50, and are juxtaposed to each other in a width direction (lateral direction) of the substrate.

The flow channel forming substrate 10 includes, at a longitudinal one end side of the pressure generating chamber 12, ink supply paths 13 and communication paths 14 which are divided by the partitioning walls 11 and each of which is in communication with respective pressure generating chamber 12. A communication portion 15 in communication with each of the communication paths 14 is provided at an outside of the communication path 14. The ink supply path 13 is formed, for example, in a width narrower than the pressure generating chamber 12 and the communication path 14 and plays a role in maintaining a constant flow channel resistance to ink flowing into the pressure generating chamber 12. The communication portion 15 is in communication with a reservoir portion 32 of a protecting film 30 which will be later described, and constitutes a part of the reservoir 110 which is an ink chamber common to each pressure generating chamber 12.

A nozzle plate 20 into which nozzles 21 in communication with the vicinity of the end of each pressure generating chamber 12 opposite to the ink supply path 13 are bored is adhered to an opening surface side of the flow channel forming substrate 10.

On the other hand, an insulating film 55 composed of an oxide film of material which is different from the elastic film 50 is formed on the elastic film 50 formed on a surface of the flow channel forming substrate 10. Then, a piezoelectric element 300 is formed over the insulating film 55. The piezoelectric element 300 is made up of a lower electrode film 60 as a first electrode, a piezoelectric layer 70 formed on the lower electrode film 60, and an upper electrode film 80 as a second electrode. In general, either one side electrode of the piezoelectric element 300 is set to be a common electrode, and the other side electrode is patterned together with the piezoelectric layer 70 for every pressure generating chamber 12 and set to be an individual electrode. In this embodiment, the lower electrode film 60 is set to be a common electrode and the upper electrode film 80 is set to be an individual electrode. In addition, as long as it falls within a range serving as the piezoelectric element 300, another layer may be provided between the lower electrode film 60 and the piezoelectric layer 70 or between the piezoelectric layer 70 and the upper electrode film 80.

Next, here, the piezoelectric element 300 and a vibrating plate in which displacement occurs by the driving of the piezoelectric element 300 are collectively referred to as an actuator. Furthermore, in the above-described example, the elastic film 50 and the insulating film 55 serve as the vibrating plate. Of course, the configuration of the vibrating plate is not particularly limited, and thus the vibrating plate may include any films other than the elastic film 50 and the insulating film 55. For example, the lower electrode film 60 constituting the piezoelectric element 300 may function as the vibrating plate. In addition, the piezoelectric element 300 itself may also serve as the vibrating plate.

A coating film 100 formed of a material having a humidity resistance is provided on this piezoelectric element 300, and the majority of the piezoelectric element 300 is covered by the coating film 100. Specifically, a hollow section 101 having no coating film 100 is provided on the upper electrode film 80, and an area of the piezoelectric element 300 other than the hollow section 101 is covered by the coating film 100. The hollow section 101 is provided so that the upper electrode film 80 is exposed at an area opposite to the upper electrode film 80 in an area opposite to the pressure generating chamber 12, i.e., a portion in which displacement actually occurs when voltage is applied to the piezoelectric element 300.

Since the majority of the piezoelectric element 300 is covered by the coating film 100, it is possible to suppress breakage of the piezoelectric element 300 due to the moisture in the atmosphere or the like. In addition, since the hollow section 101 having no coated film 100 is provided on the upper electrode film 80, decrease in a displacement amount of the piezoelectric element 300 due to the coated film 100 is suppressed and the ejecting characteristics of the ink droplets can be favorably maintained.

Furthermore, as materials for the coated film 100, those having humidity resistance, for example, inorganic insulating materials such as silicon oxide (SiOx), tantalum oxide (TaOx) and aluminum oxide (AlOx) may be listed. In particular, it is preferable to use aluminum oxide (AlOx) as inorganic amorphous material, for example, alumina ($Al_2O_3$). In a case in which aluminum oxide is used as a material for the coated film 100, even when thickness of the coated film 100 is relatively thin, such as 100 nm, it is possible to sufficiently suppress moisture permeation under a high humidity environment. Furthermore, inorganic insulating material comparatively has a higher Young's modulus than organic insulating material such as polyimide. Accordingly, when the piezoelectric element 300 is deformed, the coated film 100 formed of inorganic insulating material is more difficult to comparatively deform than that formed of organic insulating material. For this reason, the difference between the stress which the area of the piezoelectric element 300 which is covered by the coated film 100 receives and the stress which the area of the piezoelectric element 300 which is not covered by the coated film 100 receives is considerably larger than difference between the stresses in a case in which the coated film is formed of organic insulating film.

Here, although the hollow section 101 is formed, for example, by etching (for example, ion milling) the coated film 100, it is formed by removing a part of the upper electrode film 80 in a depth direction as well as the coated film 100. That is, the hollow section 101 is formed to penetrate the coated film 100 and at a depth reaching a part of the upper electrode film 80 in a thickness direction.

Figure 5:
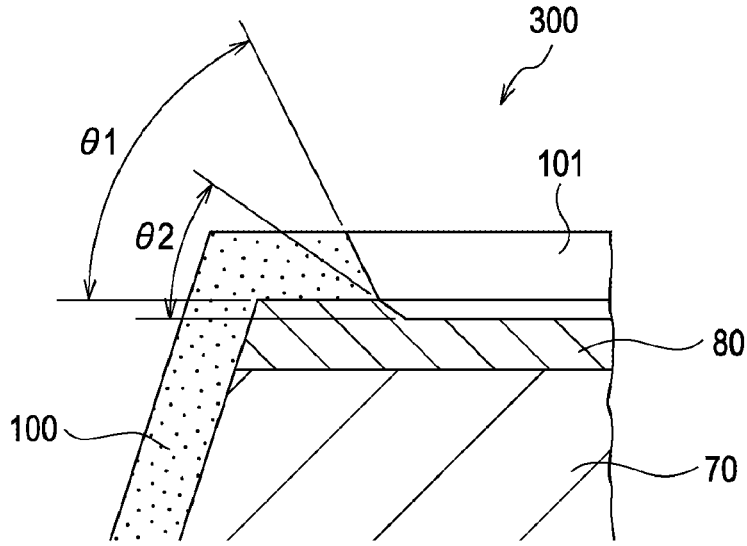
FIG. 5 is an enlarged sectional view showing an end structure of a hollow section according to an embodiment of the invention.

Next, end faces of the coated film 100 and the upper electrode film 80 constituting the hollow section 101 are formed as a sloping surface which inclines with respect to the surface of the flow channel forming substrate 10, as shown in FIG. 5, and an inclination angle θ1 of an end face of the coating film 100 with respect to the flow channel forming substrate 10 and an inclination angle θ2 of an end face of the upper electrode film 80 satisfy a relationship of θ2<θ1. Furthermore, although in FIG. 5, the inclination angle θ1 takes an interface between the upper electrode film 80 and the coated film 100 as a reference and the inclination angle θ2 takes a surface of the upper electrode film 80 (a bottom surface of the hollow section 101) as a reference, all of these surfaces are parallel to the flow channel forming substrate 10.

Since the hollow section 101 is formed so that the inclination angles θ1 and θ2 satisfy this relationship, it is possible to suppress the occurrence of cracks in the coated film 100 and the piezoelectric element 300 due to stress concentration on an end of the hollow section 101. Cracks in the coated film 100 and the piezoelectric element 300 are, in particular, apt to occur from an end of the hollow section 101 in a width direction (lateral direction) of the piezoelectric element 300 as a starting point. For this reason, the relationship of the inclination angles θ1 and θ2 may be satisfied at least at an end of the hollow section 101 in a width direction of the piezoelectric element 300 and may not be necessarily satisfied at an end of the hollow section 101 in a longitudinal direction of the piezoelectric element 300. Furthermore, although the relation between a width direction and a longitudinal direction of the piezoelectric element 300 is shown, the planar shape of the piezoelectric element 300 is not limited to a rectangular shape. A preferable shape of the piezoelectric element 300 is one that can conceptualize the width direction and the longitudinal direction; the specific shape thereof is not particularly limited, and, for example, even an elliptical shape may be possible.

Figure 6:
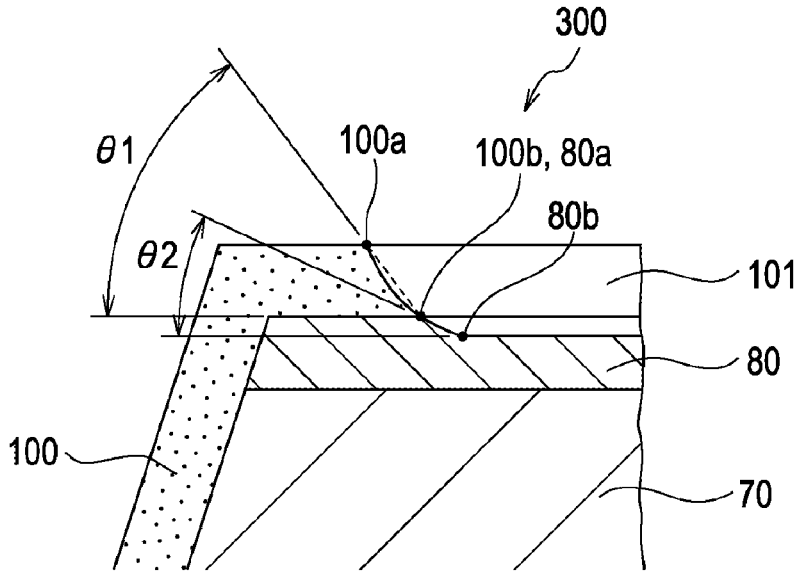
FIG. 6 is an enlarged sectional view showing a modified example of an end structure of a hollow section according to an embodiment of the invention.

In addition, there is a case in which for example, if the hollow section 101 is formed by etching, an inclination angle of the end face of the coated film 100 or the end face of the upper electrode film 80 constituting the hollow section 101 changes in a depth direction of the hollow section 101. Specifically, for example, as shown in FIG. 6, there occurs a case in which the end face of the coated film or the end face of the upper electrode film 80 constituting the hollow section 101 is formed as a curved surface.

In this case, the inclination angle θ1 is set as an inclination angle of the straight line connecting an upper end 100*a* and a lower end 100*b* of the end face of the coated film 100 with respect to the flow channel forming substrate 10, whereas the inclination angle θ2 is set as an inclination angle of the straight line connecting an upper end 80*a* (100*b*) and a lower end 80*b* of the end face of the upper electrode film 80 with respect to the flow channel forming substrate 10. Then, these inclination angles θ1 and θ2 are adapted to satisfy a relationship of θ2<θ1. This can suppress the occurrence of cracks in the coated film 100 or the piezoelectric element 300 as described above. In particular, this is effective in a configuration in which a coated film 100 formed of inorganic insulating material is provided. If the coated film 100 is formed of inorganic insulating material, since the difference between the stress which the area of the piezoelectric element 300 which is covered by the coated film 100 receives and the stress which the area of the piezoelectric element 300 which is not covered by the coated film 100 receives is relatively large as described above, cracks are apt to occur in the piezoelectric element 300 or the like. However, by making the inclination angles θ1 and θ2 satisfy a relationship of θ2<θ1, it is possible to effectively suppress the occurrence of such cracks.

Figure 7:
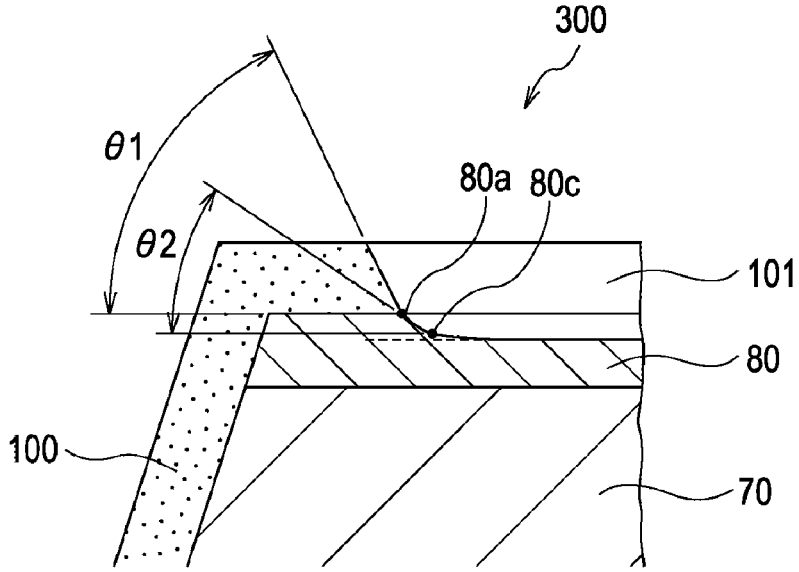
FIG. 7 is an enlarged sectional view showing a modified example of an end structure of a hollow section according to an embodiment of the invention.

In addition, there is a case in which for example, if the hollow section 101 is formed by etching, as shown in FIG. 7, curvature of the end face of the upper electrode film 80 in the vicinity of the end point of the etching becomes very large compared with other portions in the end face of the upper electrode film 80. In this case, if the inclination angle θ2 is set as an inclination angle of the straight line connecting an upper end and a lower end of the end face of the upper electrode film 80 with respect to the flow channel forming substrate 10, there is a risk that the inclination angle θ2 will become smaller than necessity. In such a case, it may be possible to set the inclination angle θ2 as an inclination angle of the straight line connecting the upper end 80*a* of the upper electrode film 80 and a position 80*c* at which etching amount of the upper electrode film 80 is approximately 70% with respect to the flow channel forming substrate 10.

Figure 8:
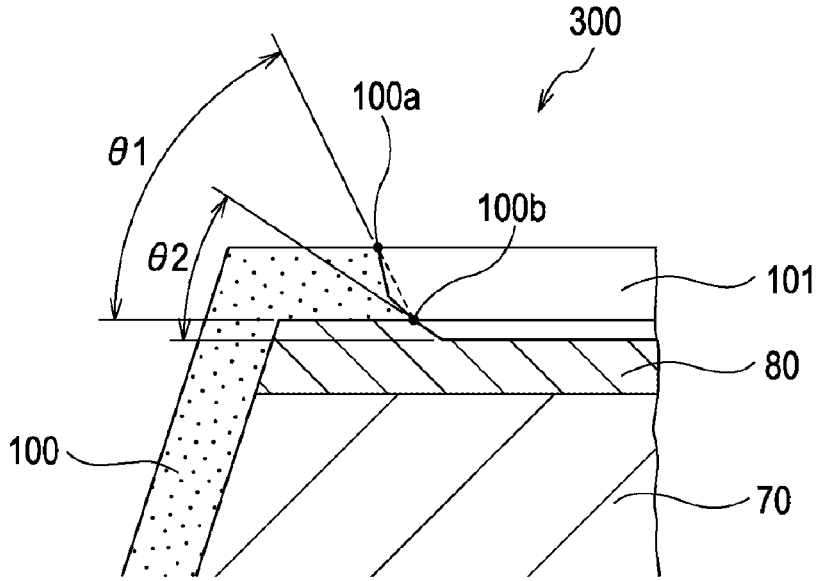
FIG. 8 is an enlarged sectional view showing a modified example of an end structure of a hollow section according to an embodiment of the invention.

In addition, even in a case other than the case in which the end face of the coated film 100 or the upper electrode film 80 constituting the hollow section 101 is formed as a curved surface, an inclination angle of the end face of the coated film 100 or the upper electrode film 80 constituting the hollow section 101 changes in a depth direction of the hollow section 101. For example, there is a case in which, as shown in FIG. 8, the end face of the coated film 100 constituting the hollow section 101 is made up of a plurality of sloping surfaces of different inclination angles. Even in the case of such a configuration, the inclination angle θ1 is set as an inclination angle of the straight line connecting an upper end 100*a* and a lower end 100*b* of the end face of the coated film 100 made up of a plurality of sloping surfaces with respect to the flow channel forming substrate 10.

Even in a case in which the end face of the coated film 100 is made up of a plurality of sloping surfaces, by making the inclination angles θ1 and θ2 satisfy a relationship of θ2<θ1, it is possible to suppress the occurrence of cracks in the coated film 100 or the piezoelectric element 300 as described above. Moreover, since the end face of the coated film 100 is made up of a plurality of sloping surfaces, it is possible to suppress separation of the coated film 100 at an end portion of the hollow section 101 as well.

In addition, in a case in which the end face of the coated film 100 is made up of a plurality of sloping surfaces of different inclination angles, it is preferable that a boundary between the sloping surfaces of different inclination angles is provided at a halfway point of the film thickness of the coated film 100 rather than in the vicinity of the boundary between the coated film 100 and the upper electrode film 80. Moreover, it is preferable that a boundary between the sloping surface and the bottom surface of the hollow section 101 is also provided at a halfway point of the film thickness of upper electrode film 80 rather than in the vicinity of the boundary between the coated film 100 and the upper electrode film 80. For example, if the boundary between the sloping surfaces is provided in the vicinity of the boundary between the coated film 100 and the upper electrode film 80, there is a risk that stress will be applied to a boundary between the coated film 100 and the upper electrode film 80 and thus separation of the coated film 100 from the boundary as a starting point will be caused. However, with such a configuration, it is possible to suppress the occurrence of separation of the coated film 100 more effectively.

Figure 9:
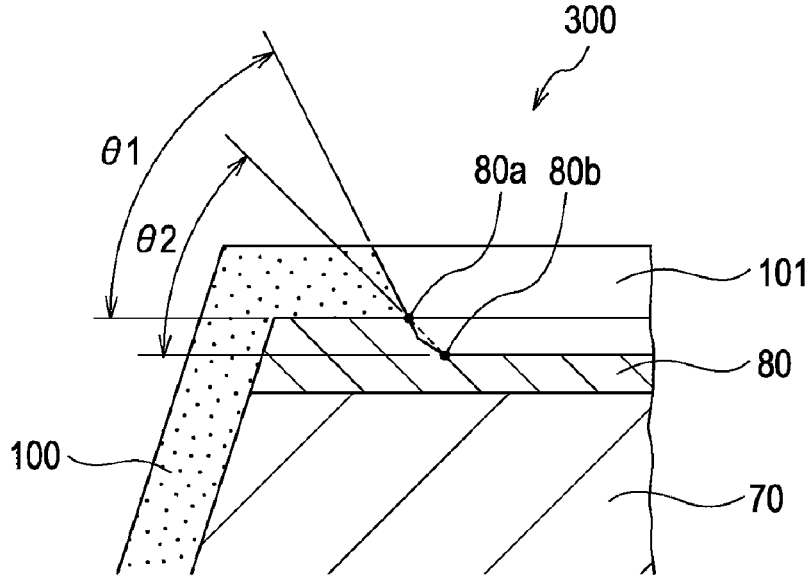
FIG. 9 is an enlarged sectional view showing a modified example of an end structure of a hollow section according to an embodiment of the invention.

In addition, there is a case in which for example, as shown in FIG. 9, the end face of the upper electrode film 80 constituting the hollow section 101 is made up of a plurality of sloping surfaces of different inclination angles. Even in the case of such a configuration, the inclination angle θ2 is set as an inclination angle of the straight line connecting an upper end 80*a* and a lower end 80*b* of the end face of the upper electrode film 80 made up of a plurality of sloping surfaces with respect to the flow channel forming substrate 10. Then, these inclination angles θ1 and θ2 are adapted to satisfy a relationship of θ2<θ1.

Even in a case in which the end face of the upper electrode film 80 is made up of a plurality of sloping surfaces, by making the inclination angles θ1 and θ2 satisfy a relationship of θ2<θ1, it is possible to suppress the occurrence of cracks in the coated film 100 or the piezoelectric element 300 as described above. Moreover, since the end face of the upper electrode film 80 is made up of a plurality of sloping surfaces, it is possible to suppress separation of the coated film 100 at an end portion of the hollow section 101 as well.

Accordingly, with this configuration, it is possible to realize an ink jet recording head in which the durability of the piezoelectric element 300 is improved and thus reliability is improved for the user.

Furthermore, a lead electrode 90 composed of, for example, gold (Au) or the like is formed on the coated film 100 and is connected with the upper electrode film 80 via a contact hole 102 formed on the coated film 100. Since the contact hole 102 is formed, for example, at a time when the hollow section 101 is formed by etching, it is formed at a depth reaching the upper electrode film 80 similarly to the hollow section 101.

A protecting substrate 30 having a photoelectric element holding portion 31 is bonded onto the flow channel forming substrate 10. The piezoelectric element holding portion 31 is configured to inhibit the air from coming therein, but is not necessarily required to be sealed. Then, the piezoelectric element 300 is formed in the piezoelectric element holding portion 31 and thus is protected in a state of being unaffected by the external environment.

In addition, the protecting substrate 30 is provided with a reservoir portion 32 at an area opposite to the communication portion 15, and the reservoir portion 32 is in communication with the communication portion 15 of the flow channel forming substrate 10 as described above and thus constitutes a reservoir 110 as an ink chamber common to each pressure generating chamber 12. In addition, a through hole 33 which penetrates the protecting substrate 30 in a thickness direction is provided at an area between the piezoelectric element holding portion 31 and the reservoir portion 32 of the protecting substrate 30, and a part of the lower electrode film 60 and a leading end of the lead electrode 90 are exposed into the through hole 33.

In addition, a compliance substrate 40 made up of a sealing film 41 and a fixing plate 42 is bonded onto the protecting substrate 30. Here, the sealing film 41 is formed of a material having flexibility with low rigidity, and one side surface of the reservoir portion 32 is sealed by the sealing film 41. In addition, the fixing plate 42 is formed of hard material such as metal. Since an area of the fixing plate 42 opposite to the reservoir 110 is an opening portion 43 which is completely removed in a thickness direction, one side surface of the reservoir 110 is sealed by only the sealing film 41 having flexibility.

In the ink jet recording head according to this embodiment, after ink taken from an external ink supply unit (not shown) fills the inside of the head until it reaches the nozzle 21 from the reservoir 110, according to a recording signal from a driving circuit (not shown), voltage is applied to each of the piezoelectric elements 300 corresponding to the pressure generating chambers 12 to deform the piezoelectric element flexibly so that pressure in each of the pressure generating chambers 12 is increased in order to eject ink droplets from the nozzle 21.

In addition, an ink jet recording head according to the above described embodiment constitutes a part of a recording head unit including an ink flow channel in communication with an ink cartridge or the like, and is mounted on an ink jet recording apparatus.

Figure 10:
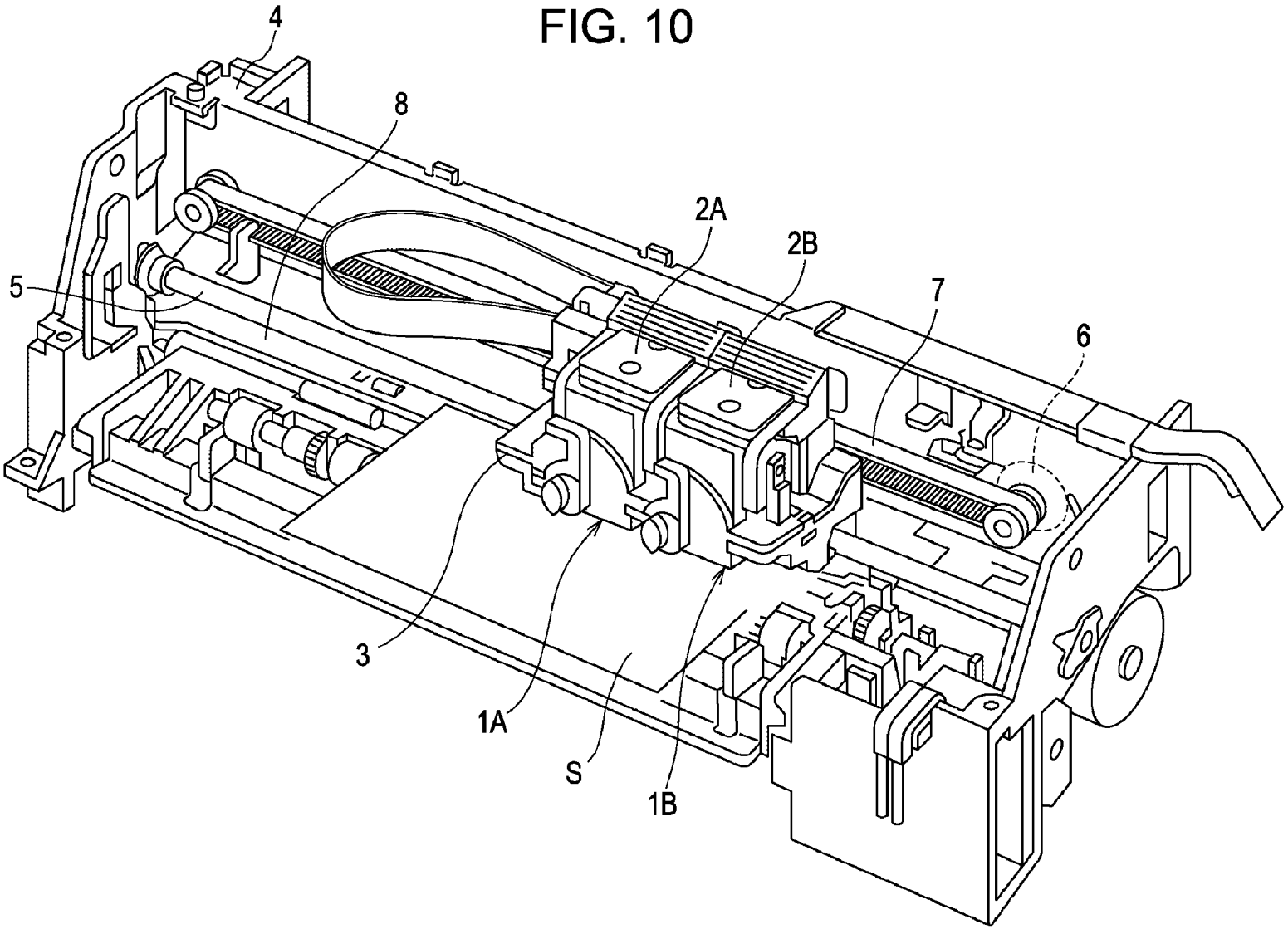
FIG. 10 is a schematic perspective view of a recording apparatus according to an embodiment of the invention.

As shown in FIG. 10, cartridges 2A and 2B constituting an ink supplying unit are detachably mounted on the recording head units 1A and 1B including the ink jet recording head. A carriage 3 on which the recording head units 1A and 1B are mounted is arranged to be able to axially move on a carriage shaft 5 attached to an apparatus main body 4. The recording head units 1A and 1B are, for example, adapted to eject a black ink composition and a color ink composition, respectively. Then, by transmitting the driving force of a drive motor 6 to the carriage 3 via a plurality of gears (not shown) and a timing belt 7, the carriage 3 on which the recording head units 1A and 1B are mounted moves along the carriage shaft 5. On the other hand, the apparatus main body 4 is provided with a platen 8 along the carriage shaft 5, and a recording sheet S which is a recording medium such as paper fed by a paper feeding roller (not shown) or the like is adapted to be carried on the platen 8.

In the foregoing, although an embodiment of the invention has been described, the invention is not limited to that embodiment. For example, although the above described embodiment illustrates the ink jet recording head as a liquid ejecting head and the ink jet recording apparatus as a liquid ejecting apparatus, the invention broadly relates to a general liquid ejecting head and a general liquid ejecting apparatus and, of course, can be applied to a liquid ejecting head ejecting liquids other than ink and a liquid ejecting apparatus including the same. As other liquid ejecting heads, for example, various recording heads used in an image recording apparatus such as a printer, a color material ejecting head used for manufacturing a color filter such as a liquid crystal display, an electrode material ejecting head used in forming an electrode of an organic EL display, FED (field emission display) or the like, a bio organic substance ejecting head used in manufacturing a bio chip, etc. may be listed.

In addition, the invention can be applied to the actuator mounted on all these apparatuses as well as the actuator mounted on such liquid ejecting heads (ink jet recording head). The actuator according to the invention can be applied to, for example, sensors or the like as well as the above described head.

What is claimed is:

1. A liquid ejecting head, comprising:

a flow channel forming substrate in which pressure generating chambers in communication with nozzles are formed;

a piezoelectric element made up of a first electrode formed over the flow channel forming substrate, a piezoelectric layer formed over the first electrode and a second electrode formed over the piezoelectric layer; and a coating film provided by coating the piezoelectric element, wherein a hollow section formed by removing the coating film and a part of the second electrode is provided at an area opposite to the piezoelectric element, and an inclination angle θ1 of an end face of the coating film defining the hollow section with respect to the flow channel forming substrate and an inclination angle θ2 of an end face of the second electrode defining the hollow section satisfy a relationship of $\theta 2<\theta 1$.

2. The liquid ejecting head according to claim 1, wherein in a case in which an inclination angle of an end face of the coated film or the second electrode constituting the hollow section changes in a depth direction of the hollow section, the inclination angle θ1 is an inclination angle of a straight line connecting an upper end and a lower end of the end face of the coated film with respect to the flow channel forming substrate, and the inclination angle θ2 is an inclination angle of a straight line connecting an upper end and a lower end of the end face of the second electrode with respect to the flow channel forming substrate.

3. A liquid ejecting apparatus comprising the liquid ejecting head according to claim 1.

4. The liquid ejecting head according to claim 2, wherein at least one of the end face of the coated film and the end face of the second electrode constituting the hollow section is formed by a curved surface.

5. The liquid ejecting head according to claim 2, wherein at least one of the end face of the coated film and the end face of the second electrode constituting the hollow section is formed by a plurality of sloping surfaces of different inclination angles.

6. An actuator comprising:

a piezoelectric element made up of a first electrode formed over a substrate, a piezoelectric layer formed over the first electrode and a second electrode formed over the piezoelectric layer; and a coating film provided by coating the piezoelectric element, wherein a hollow section formed by removing the coating film and a part of the second electrode is provided at an area opposite to the piezoelectric element, and an inclination angle θ1 of an end face of the coating film defining the hollow section with respect to the flow channel forming substrate and an inclination angle θ2 of an end face of the second electrode defining the hollow section satisfy a relationship of $\theta 2<\theta 1$.

* * * * *